US008729991B2

(12) United States Patent
Nishimura

(10) Patent No.: US 8,729,991 B2
(45) Date of Patent: May 20, 2014

(54) COIL TERMINAL

(75) Inventor: Tsukasa Nishimura, Hokkaido (JP)

(73) Assignee: Panasonic Corporation, Osaka (JP)

( * ) Notice: Subject to any disclaimer, the term of this patent is extended or adjusted under 35 U.S.C. 154(b) by 125 days.

(21) Appl. No.: 12/892,095

(22) Filed: Sep. 28, 2010

(65) Prior Publication Data

US 2011/0095854 A1 Apr. 28, 2011

(30) Foreign Application Priority Data

Oct. 26, 2009 (JP) ..... 2009-245541

(51) Int. Cl.
*H01F 7/00* (2006.01)

(52) U.S. Cl.
USPC ..... 335/219; 335/281

(58) Field of Classification Search
USPC ..... 335/219; 439/874
See application file for complete search history.

(56) References Cited

U.S. PATENT DOCUMENTS

| | | | | |
|---|---|---|---|---|
| 2,684,423 | A * | 7/1954 | Hipple | 219/79 |
| 4,701,735 | A * | 10/1987 | Hill et al. | 335/282 |
| 4,926,548 | A * | 5/1990 | Hopkins et al. | 29/860 |
| 5,307,038 | A * | 4/1994 | Ishimaru | 335/296 |
| 5,320,206 | A * | 6/1994 | Maejima | 192/84.961 |
| 5,812,044 | A * | 9/1998 | Sakamoto | 335/299 |
| 5,944,567 | A * | 8/1999 | Ratajczak et al. | 439/874 |
| 5,967,282 | A * | 10/1999 | Takahashi | 192/84.961 |
| 6,031,444 | A * | 2/2000 | Agata et al. | 336/192 |
| 6,206,719 | B1 * | 3/2001 | Tsunezawa et al. | 439/395 |
| 6,707,365 | B2 * | 3/2004 | Fuju | 336/185 |
| 6,914,507 | B2 * | 7/2005 | Fujiu | 336/192 |
| 7,772,946 | B2 * | 8/2010 | Oh et al. | 335/219 |
| 2003/0043008 | A1 | 3/2003 | Fujiu | |
| 2009/0243409 | A1 * | 10/2009 | Ohta | 310/71 |

FOREIGN PATENT DOCUMENTS

| | | | |
|---|---|---|---|
| CN | 1239804 | A | 12/1999 |
| CN | 1356449 | A | 7/2002 |
| JP | 5-205962 | A | 8/1993 |
| JP | 11-067526 | A | 3/1999 |
| JP | 2003-332123 | | 11/2003 |

OTHER PUBLICATIONS

Korean Office Action, Application No. KR 10-2010-0095001, dated Oct. 21, 2011.
The First Office Action of Chinese Patent Application No. 2010105170551 with English translation issued Jan. 7, 2013.
Korean Notice of Allowance for counterpart Korean Application No. 10-2010-0095001 dated Jun. 28, 2012, two (2) pages.

* cited by examiner

*Primary Examiner* — Shawki S Ismail
*Assistant Examiner* — Lisa Homza
(74) *Attorney, Agent, or Firm* — Nath, Goldberg & Meyer; Jerald L. Meyer; Stanley N. Protigal

(57) ABSTRACT

According to one embodiment, a coil terminal is electrically connected to a coil being wound around an electromagnetic block and connected to a coated wire. The coil terminal includes a connection portion electrically connected to the coil, and a terminal body portion extending from the connection portion and connected to the coated wire. The terminal body portion includes a slit formed in the longitudinal direction of the coated wire from one end to the other end of the terminal body portion, a base portion formed on the other end of the coil terminal, and a pair of parallel beam portions extending toward one end of the coil terminal from the base portion with the slit interposed between the pair of beam portions. The pair of beam portions may protrude in a thickness direction of the terminal body portion. The coated wire may be disposed within the slit and a core wire at the tip end of the coated wire may be soldered to the base portion.

3 Claims, 8 Drawing Sheets

COIL TERMINAL

CROSS-REFERENCE TO RELATED APPLICATIONS

This application is based upon and claims the benefit of priority from Japanese Patent Application No. 2009-245541 filed on Oct. 26, 2009, the entire contents of which are incorporated herein by reference.

FIELD

Embodiments described herein relate generally to a coil terminal.

BACKGROUND

A relay may be equipped with an electromagnetic block around which a coil is wound, and a contact block driven by the electromagnetic block and operated to open/close a contact. The relay may incorporate a connecting unit configured to connect a coated wire to a coil terminal electrically connected to the coil. Some known examples of a connecting unit include a unit configured to connect the coated wire to the coil terminal by soldering, and a unit configured to engage the coated wire with the coil terminal to connect therebetween.

FIG. 7 illustrates one example of the soldering-based connecting unit. As shown in FIG. 7, the soldering-based connecting unit may connect a core wire 81 uncovered at the tip end of a coated wire 8 to a coil terminal 7 formed in a roughly flat plate shape. Wherein the coil terminal 7 is electrically connected with a coil 22 which is wound around an electromagnetic block 2.

Unfortunately, when soldering the coated wire 8 to the coil terminal 7, the connecting unit is not equipped with a holding unit adapted to hold the coated wire 8 on the coil terminal coil terminal 7. This may cause an unstable connection therebetween, thereby leading to poor quality.

FIGS. 8(*a*) and 8(*b*) are enlarged views of the coil terminal in an electromagnetic block. As shown in FIGS. 8(*a*) and 8(*b*), when soldering the coated wire 8 to the coil terminal 7, placing the coated wire 8 along a surface on which the coil terminal 7 is bonded may produce a space S between the core wire 81 of the coated wire 8 and the bonding surface of the coil terminal 7. The space S corresponds to a covering thickness of the coated wire 8. As such, the soldering requires bending the coated wire 81 toward the bonding surface and then placing the coated wire 81 along the bonding surface. This may put some stress on the core wire 81, resulting in a degraded bonding strength between the coated wire 8 and the coil terminal 7.

DETAILED DESCRIPTION

According to one embodiment, a coil terminal is electrically connected to a coil being wound around an electromagnetic block and connected to a coated wire, the coil terminal includes a connection portion capable of being electrically connected to the coil, and a terminal body portion extending from the connection portion and capable of being connected to the coated wire. The terminal body portion has a base portion formed on a first end of the coil terminal, and a pair of parallel beam portions extending toward a second end of the coil terminal from the base portion. The parallel beam portions may protrude in a thickness direction of the terminal body portion and form a slit interposed between the pair of parallel beam portions. The coated wire may fit within the slit and a core wire at the tip end of the coated wire is capable of being soldered to the base portion.

Embodiments disclosed herein will be further described with the accompanying drawings.

<First Embodiment>

Figure 1:
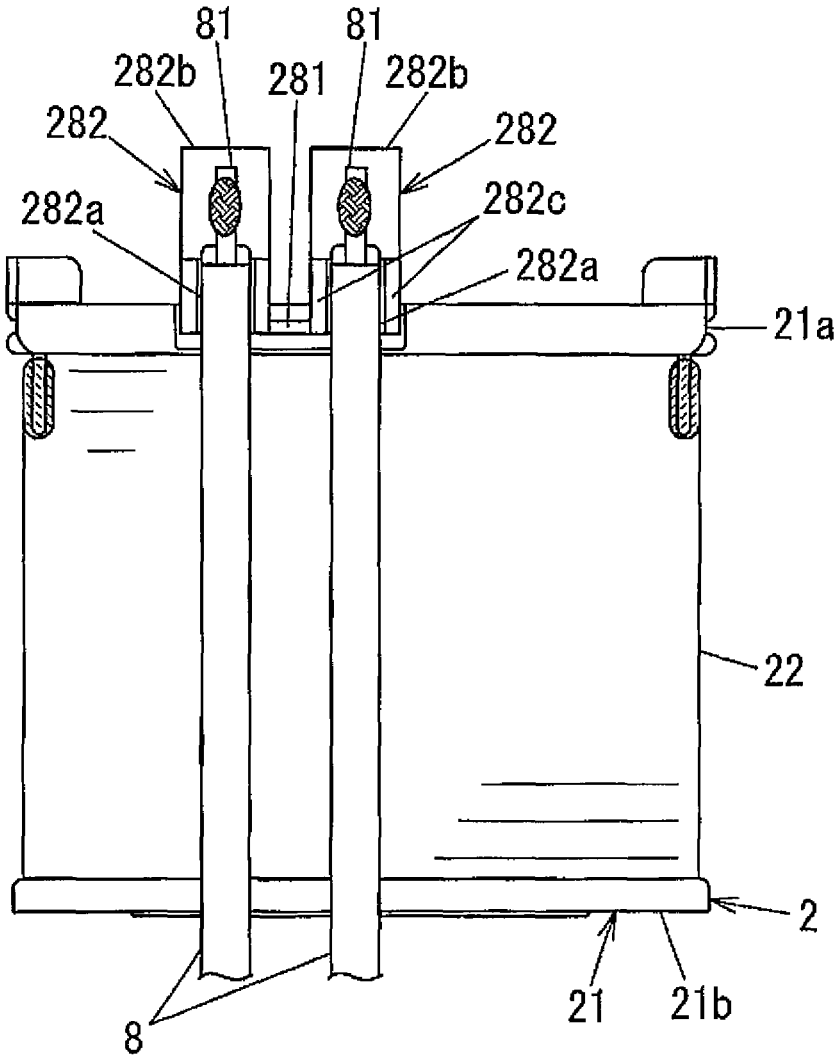
FIG. 1 is a front view of an electromagnetic block having a coil terminal according to a first embodiment.
Figure 2:
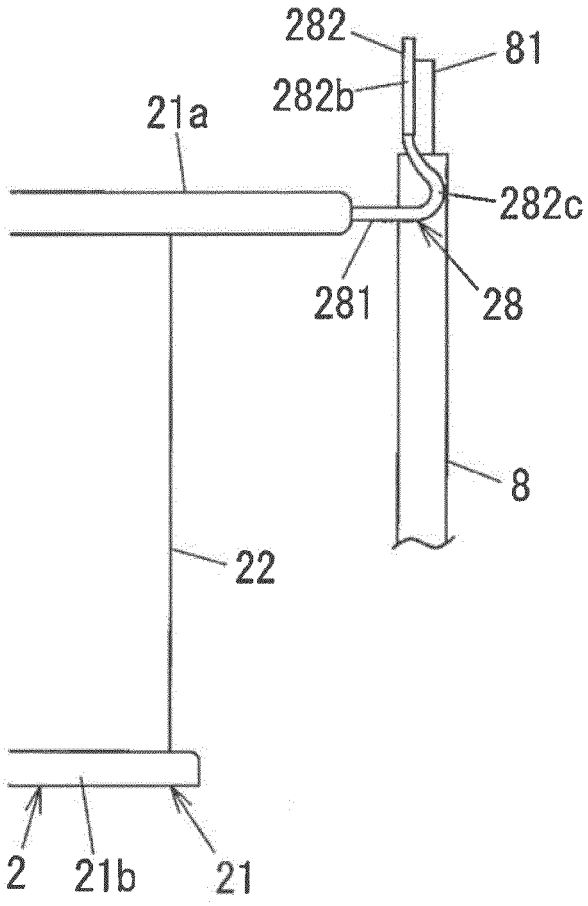
FIG. 2 is a side-elevational view of the electromagnetic block shown in FIG. 1.

A detailed description will be made as to an illustrative first embodiment of a coil terminal which is applied to an electromagnetic block 2 in a relay as shown in FIGS. 1 and 2. However, the technical features of the illustrative embodiment are not limited to a relay and may apply to electronic devices in general other than the relay.

Figure 3A:
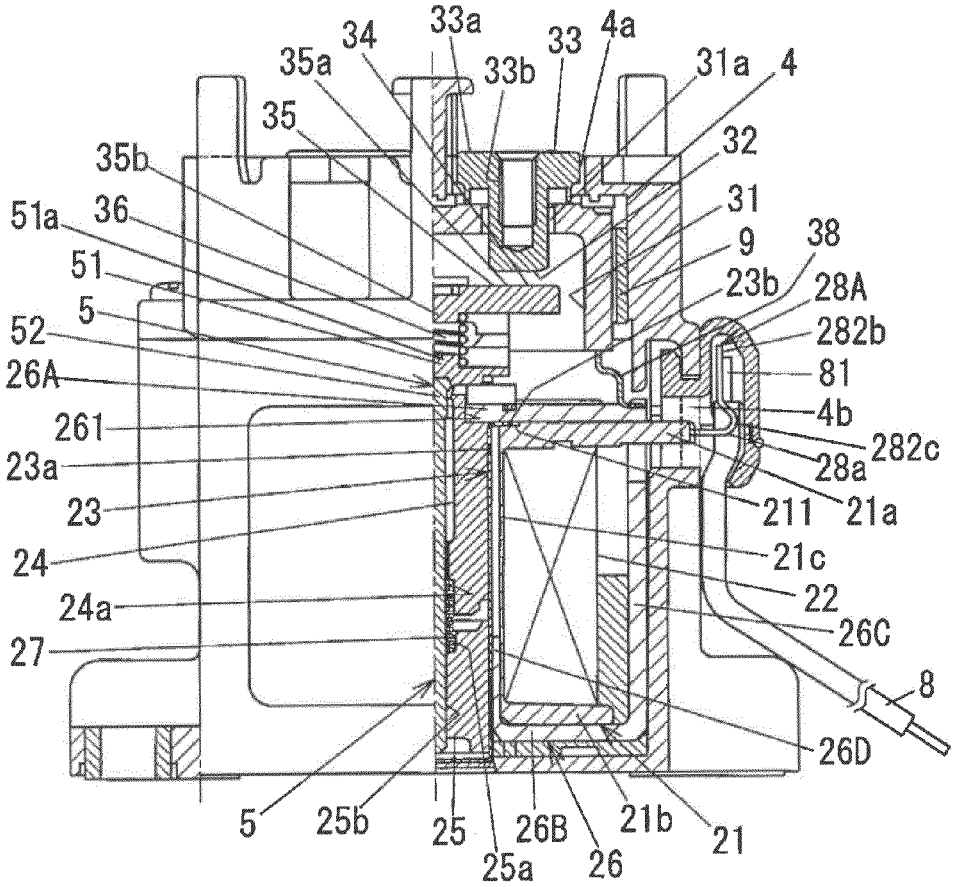
FIG. 3A is a perspective view of a relay having a coil terminal according to the first embodiment.

Initially, a description will be made as to the overall structure of the relay of an illustrative embodiment. Hereinafter, it is assumed that left, right, up, and down directions are determined based on FIG. 3A respectively and the direction orthogonal to the left-right-up-down direction in FIG. 3A is set to an anteroposterior direction.

Figure 3B:
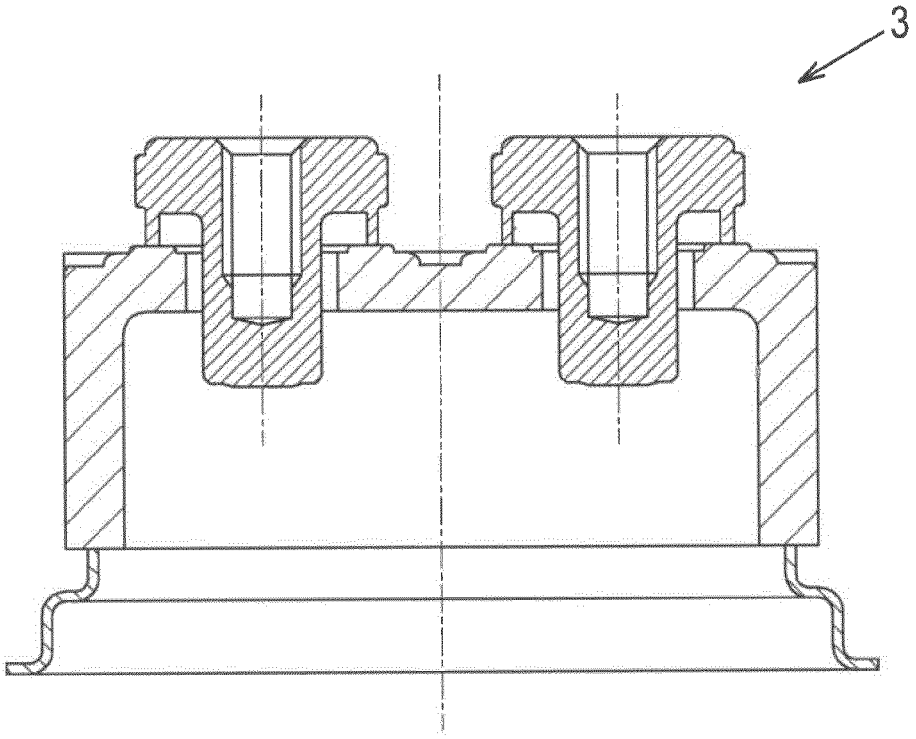
FIG. 3B is a perspective view of a contact block in the relay shown in FIG. 3A.
Figure 3C:
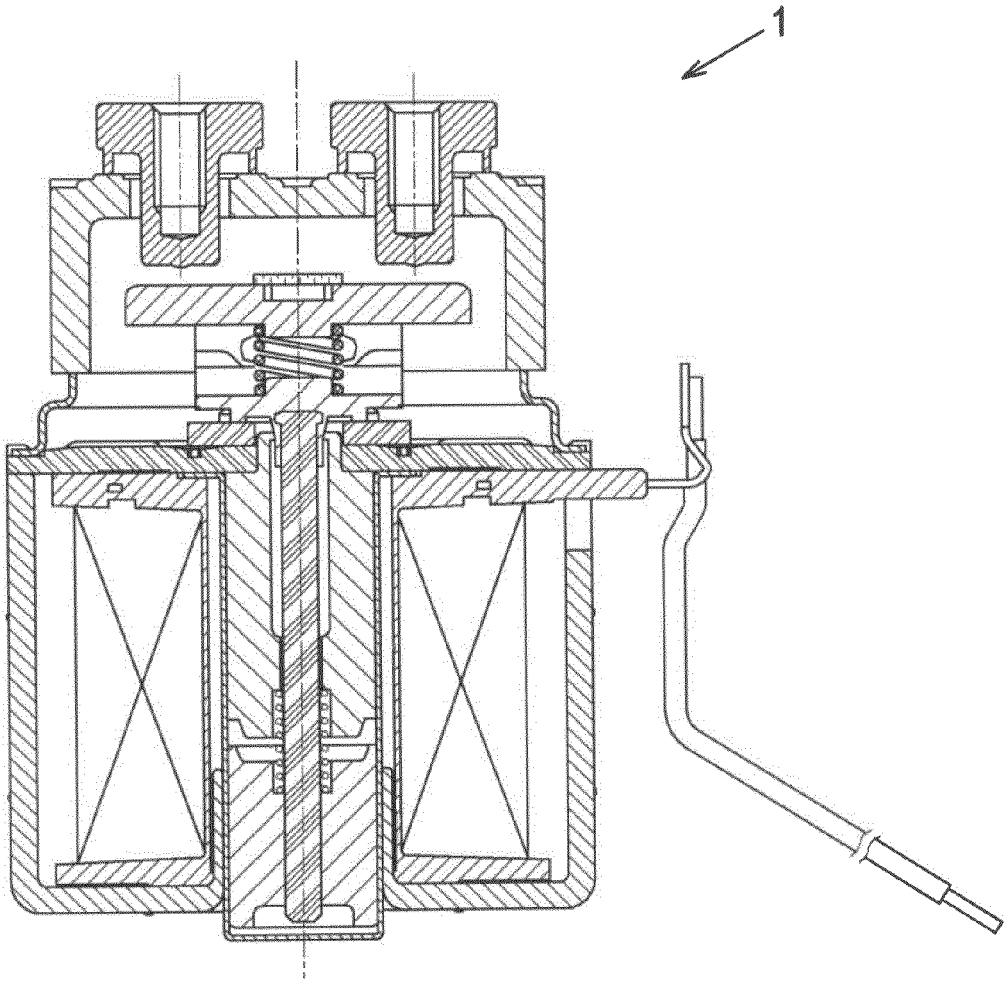
FIG. 3C is a perspective view of an internal unit block in the relay shown in FIG. 3A.

In the relay, housed in a hollow box shape of housing 4 are an internal unit block 1 (see FIG. 3C) configured to contain an electromagnetic block 2, and a contact block 3 (see FIG. 3B) which are integrated with one another, and a yoke 9 configured to remove arcs that are generated between contacts at the contact block 3 (see FIG. 3B) in a short period of time.

The electromagnetic block 2 may include a hollow-cylindrical coil bobbin 21, a cylindrical member 23, a fixed iron-core 24, a movable iron-core 25, a yoke 26, a return spring 27, and coil terminal 28A. The coil bobbin 21 may be made of an insulating material and have a coil 22 wound therearound. The cylindrical member 23 is formed in a roughly cylindrical shape with its lower face closed and inserted into the inner diameter portion of the coil bobbin 21 from above. The fixed iron-core 24 is fixed within the cylindrical member 23 and configured to be magnetized by the conducted coil 22. The movable iron-core 25 is disposed within the cylindrical member 23 opposite the fixed iron-core 24 in an axial direction and configured to be attracted to the fixed iron-core 24 in response to ON/OFF operation of conduction of the coil 22 to move in the axial direction within the cylindrical member 23. The yoke 26 may be made of a magnetic material and configured to encompass the coil bobbin 21. The return spring 27 is disposed to adjoin the fixed iron-core 24 at its upper end and the movable iron-core 25 at its lower end, and is configured to push the movable iron-core 25 downward. The coil terminal 28A is connected to both ends of the coil 22.

The contact block 3 may include a sealed container 31, a fixed terminal 33, a movable contactor 35, a contact pressure spring 36, and a movable shaft 5. The sealed container 31 may be made of an insulating material and may be formed in a hollow box-shape where the lower face is open. The fixed terminal 33 may be formed in a roughly cylindrical shape and inserted through the upper face of the sealed container 31. The fixed terminal 33 has a fixed contact 32 formed at its lower face. The movable contactor 35 has a movable contact 34 configured to make contact with and separate from the fixed contact 32 and is placed within the sealed container 31. The contact pressure spring 36 adjoins the lower face of the movable contactor 35 to push the movable contactor 35 toward the fixed terminal 33. The movable shaft 5 adjoins the contact pressure spring 36 at its upper end and is connected with the movable iron-core 25 at its lower end, thereby moving in interlocking movement with the movable iron-core 25.

The coil bobbin 21 may be made of a resin material. The coil bobbin 21 includes a body part 21*c* formed in a roughly hollow-cylindrical shape, a flange part 21*a* formed on the upper end of the body part 21*c*, and a flange part 21*b* formed on the lower end of the body part 21*c*. The coil 22 is wound around the body part 21*c*.

The cylindrical member 23 includes a cylindrical part 23*a* inserted within the coil bobbin 21, and a flange part 23*b* formed on the top end of the cylindrical part 23*a*. The flange part 23*b* is engaged into a recessed portion 221 which is formed on a peripheral edge of an opening located approximately at the center of the upper face of the coil bobbin 21.

Disposed on a lower end side of the cylindrical part 23*a* of the cylindrical member 23 is a movable iron-core 25 that is made of a magnetic material and formed in a roughly cylindrical shape. Inserted into the upper side of the movable iron-core 25 is a fixed iron-core 24 that is made of a magnetic material and formed in a roughly cylindrical shape. The fixed iron-core 24 and the movable iron-core 25 are located opposite each other. A recessed portion 24*a* and a recessed portion 25*a* are formed on the upper face of the fixed iron-core 24 and the lower face of the movable iron-core 25, respectively. Each of the recessed portions 24*a* and 25*a* has a diameter that is approximately equal to an outer diameter of a return spring 27. The return spring 27 adjoins the lower face of the recessed portion 24*a* at its upper end and the lower face of the recessed portion 25*a* at its lower end.

The yoke 26 includes a first and a second yoke plate 26A and 26B, a pair of third yoke plates 26C and a fourth yoke plate 26D. The first yoke plate 26A is formed in a roughly rectangular plate shape and disposed lapping over an upper face of the flange part 21*a*. The second yoke plate 26B is formed in a roughly rectangular plate shape and disposed at the lower end side of the coil bobbin 21. The pair of third yoke plates 26C extends upward from both left and right ends of the second yoke plate 26B. The fourth yoke plate 26D is formed in a roughly cylindrical shape and extends upward from a peripheral edge of an opening having a circular shape located approximately at the center of the second yoke plate 26B, the peripheral edge being formed in a roughly circle shape.

The first yoke plate 26A is disposed lapping over the upper face of the flange part 21*a* of the coil bobbin 21, thereby preventing the cylindrical member 23 and the fixed iron-core 24 from being removed.

The fourth yoke plate 26D is inserted between an inner peripheral face of the lower end side of the coil bobbin 21 and an outer peripheral face of the cylindrical member 23, thereby constituting a magnetic circuit along with the yoke 26, the fixed iron-core 24 and the movable iron-core 25.

The return spring 27 is disposed in a compressed state between the fixed iron-core 24 and the movable iron-core 25, thereby elastically pushing the movable iron-core 25 downward.

Figure 4:
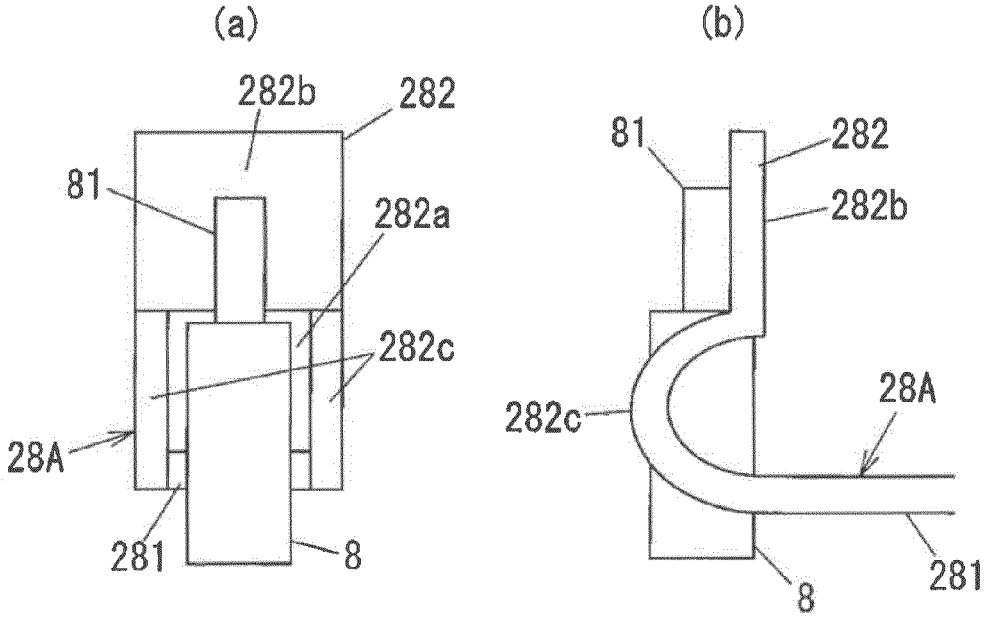
FIG. 4 is an enlarged view of a coil terminal according to the first embodiment.

As shown in FIG. 4, the coil terminal 28A includes a connection portion 281 and a terminal body portion 282. The connection portion 281 may be fitted and fixed to the periphery of the flange part 21*a* of the coil bobbin 21. The terminal body portion 282 extends approximately vertical to the connection portion 281 from the end of the connection portion 281 and is connected with the coated wire 8.

The end of the coil 22 is engaged with the connection portion 281 to allow the coil terminal 28A and the coil 22 to be electrically connected.

The terminal body portion 282 may include a slit 282*a*, a base portion 282*b* and a pair of beam portions 282*c*. The slit 282*a* may be formed toward the tip end of the coil terminal 28A from a bended portion 28*a* of the coil terminal 28A. The base portion 282*b* may be formed in a roughly plate shape and located on the tip end of the coil terminal 28A. The pair of beam portions 282*c* may extend toward the bended portion 28*a* of the base portion 282*b* from the lower end of the base portion 282*b* (i.e., the top end of the slit 282*a*) and the slit is interposed between the pair of beam portions 282*c*. The pair of beam portions 282*c* may also protrude in a thickness direction thereof (i.e., in a direction opposite to the connection portion 281).

The movable shaft 5 may include a shaft part 52 and a flange part 51. The shaft part 52 may be made of a nonmagnetic material and formed in the shape of an axially stretched round rod. The flange part 51 may be integrated with the shaft part 52 and located at the upper end of the shaft part 52.

The shaft part 52 may penetrate a through-hole 261 formed approximately at the center of the first yoke plate 26A, the fixed iron-core 24 and the return spring 27. The lower end of the shaft part 52 may be fitted and inserted into a through-hole 25*b* which is formed in an axial direction of the movable iron-core 25. Thus, the shaft part 52 may be connected with the movable iron-core 25. The upper end of the shaft part 52 may protrude upward from the through-hole 261 formed on the first yoke plate 26A, thereby allowing the protruded portion to be connected with the shaft part 52.

The flange part 51 may be made of a soft iron in a roughly rectangular plate shape. The lower end of the contact pressure spring 36 may be fitted to a convex portion 51*a* formed approximately at the center of the flange part 51.

The movable contactor 35 may include the body part 35*a* having a roughly rectangular shape, and movable contacts 34 may be fixed to both left and right ends of the body part 35*a*. The upper end of the contact pressure spring 36 may be fitted to a convex portion 35*b* formed approximately at the center of the lower face of the body portion 35*a*.

The fixed terminal 33 may be made of an electrically-conductive material such as copper and formed in a roughly cylindrical shape. The fixed terminal 33 may have a flange part 33*a* formed on its upper end, and the fixed contact 32 firmly fixed on its lower end opposite the movable contact 34. A threaded hole 33*b* may be formed through the upper face of the fixed terminal 33 in the axial direction.

The sealed container 31 may be made of a heat-resistant material such as ceramic and formed in a hollow box shape with an opened lower face. Formed through the upper face of the sealed container 31 may be two through-holes 31*a* configured so that the fixed terminal 33 may be inserted therethrough. The fixed terminal 33 may be inserted into the through-holes 31*a* with the flange part 33*a* protruding from the upper face of the sealed container 31 and may be brazed with the through-holes 31*a*. One end of the flange 38 may be bonded to a peripheral edge of an opening of the sealed container 31 by a brazing, and the other end of the flange 38 may be bonded to the upper face of the first yoke plate 26A by brazing or welding. Thus, the sealed container 31 may be sealed.

Formed on the periphery of the sealed container 31 may be a yoke 9 formed in a roughly reverse C-shape.

The contact pressure spring 36 may be disposed in a compressed state between the lower face of the movable contactor 35 and the upper face of the flange part 51 of the movable shaft 5, thereby elastically pushing the movable contactor 35 toward the fixed contact 32.

The case 4 may be made of a resin material in a roughly rectangular box shape and the internal unit block may be held in the case 4. The case 4 may have an opening 4*a* through which the flange part 33*a* of the fixed terminal 33 is exposed externally and an opening 4*b* through which the coil terminal 28A is exposed externally.

Connected to the coil terminal 28A may be the other end of the coated wire 8 having one end connected to an external power supply, for example. Such connecting may allow the coil 22 to be conducted via the coated wire 8. The movable iron-core 25 may be attracted to the fixed iron-core 24 magnetized by the electrically conducted coil 22. The attraction may make the movable iron-core 25 slidably move upward and accordingly make the movable shaft 5 connected to the movable iron-core 25 to move upward in interlocking movement with the movable iron-core 25. As a result, the flange part 51 of the movable shaft 5 may allow the movable contactor 35 to move upward via the contact pressure spring 36, which in turn, allows the movable contact 34 to be firmly fixed on the movable contactor 35 to make contact with the fixed contact 32, thereby rendering them electrically conductive.

In the coil terminal 28A according to the first embodiment, when connecting the coated wire 8 to the coil terminal 28A, the tip end of the coated wire 8 may be disposed at the slit 282*a* formed between the pair of beam portions 282*c* of the terminal body portion 282, as shown in FIGS. 4(*a*) and 4(*b*). The core wire 81 of the coated wire 8, which is exposed by stripping away the coating from the coated wire 8, may be soldered and fixed to the base portion 282*b* of the terminal body portion 282.

In soldering between the coated wire 8 and the coil terminal 28A, the pair of beam portions 282*c* disposed in parallel is configured to regulate a traversal movement of the coated wire 8, which in turn facilitates positioning of the coated wire 8 on the coil terminal 28A, thereby achieving a more stable connection.

Further, according to the first embodiment, the coated wire 8 is disposed within the slit 282*a*. Therefore, when connecting the core wire 81 to base portion 282*b* by soldering, the coating of the coated wire 8 does not interfere with the coil terminal 28A to prevent a gap from being made between the core wire 81 and the base portion 282*b*. As such, the core wire 81 is not subject to bending, thereby preventing the bending load from being applied to the core wire 81. According to the embodiment, it is possible to prevent a connection strength between the coil terminal 28A and the coated wire 8 from being degraded, thereby achieving a more stable connection.

<Second Embodiment>

Figure 5:
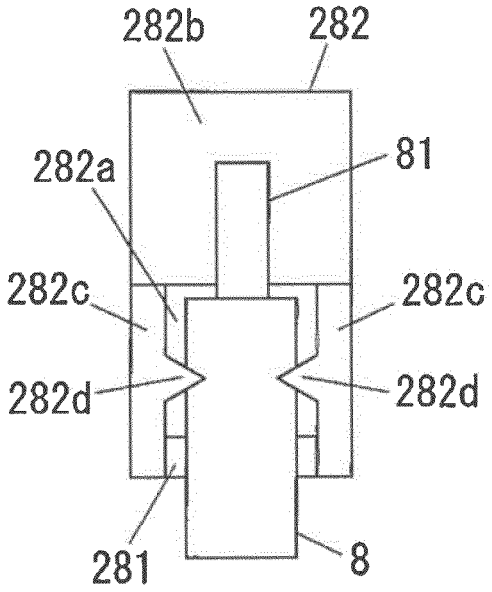
FIG. 5 is an enlarged view of another type of coil terminal according to the first embodiment.

In a second embodiment, as shown in FIG. 5, a pair of protrusions 282*d* may be formed in the pair of beam portions 282*c*. Each of the pair of protrusions 282*d* may be formed in a roughly triangle shape where the tip section protrudes toward its counterpart. The protrusions may regulate movement of the coated wire 8 connected to the coil terminal 28A in a direction perpendicular to the protruded direction (i.e., in an anteroposterior direction in FIG. 5). Therefore, it is possible to achieve a stable connection between the coated wire 8 and the coil terminal 28A.

In the second embodiment, even though it is illustratively described that the coated wire 8 is soldered to the coil terminal 28A, it is noted that the embodiment is not limited thereto, and various connecting methods such as melting may be utilized.

<Third Embodiment>

Figure 6:
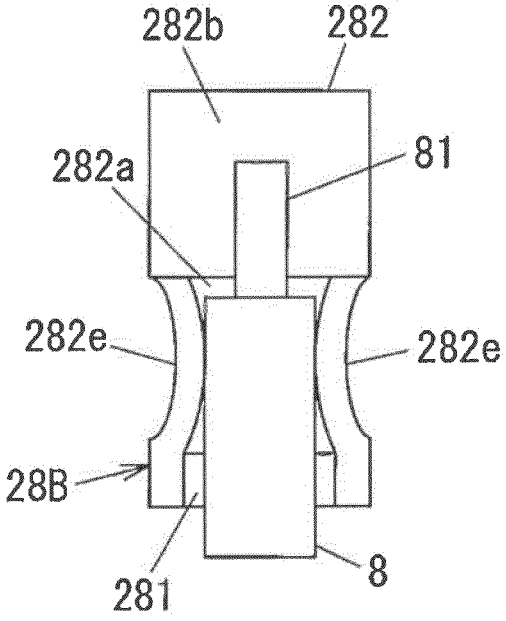
FIG. 6 is an enlarged view of a coil terminal according to a second embodiment.
Figure 7:
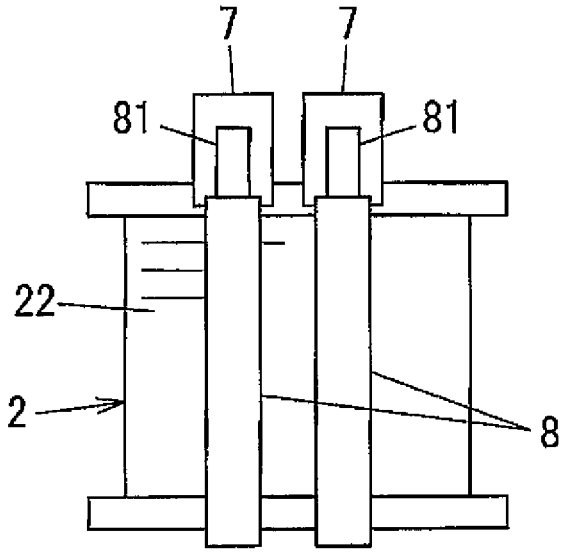
FIG. 7 (PRIOR ART)
FIG. 7 is a front view of a conventional electromagnetic block with a coil terminal.
Figure 8:
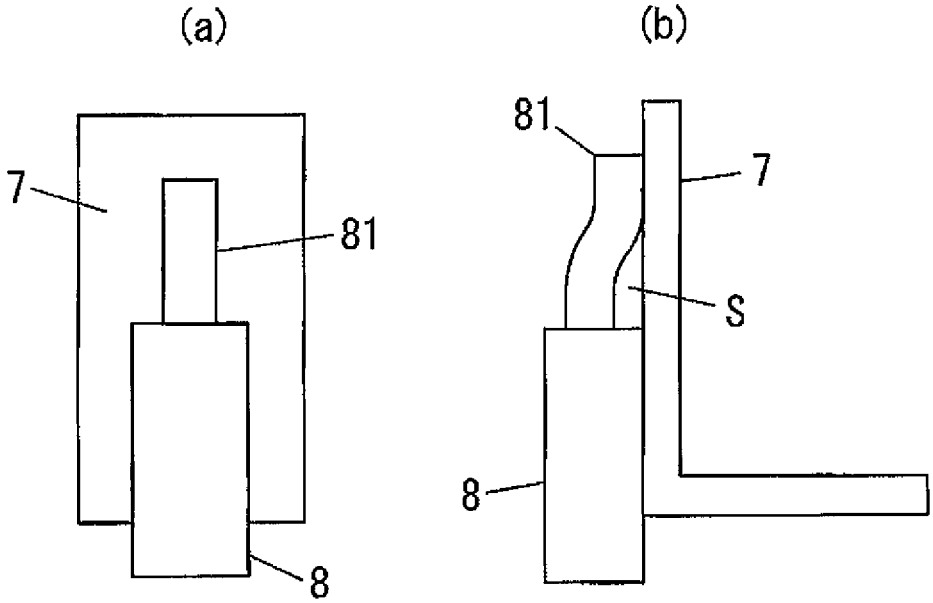
FIG. 8 (PRIOR ART)
FIG. 8 is an enlarged view of the coil terminal according to the conventional electromagnetic block shown in FIG. 7.

FIG. 6 shows a third embodiment of a coil terminal 28B. The structure of a coil terminal 28B according to the third embodiment is identical to that of the coil terminal 28A according to the second embodiment except the shape of beam portions 282*e* of the terminal body portion 282, and therefore a description of members identically labeled to those in the second embodiment will be omitted to avoid duplication.

As shown in FIG. 6, the pair of beam portions 282*e* of the coil terminal 28B according to the third embodiment may be formed in an incurved shape where the incurved section is curved toward its counterpart. A space between the pair of beam portions 282*e* may be approximately equal in size to the outer diameter of the coated wire 8. This may allow the coated wire 8 to be held by the pair of beam portions 282*e*, thereby regulating a traversal movement of the coated wire 8 (i.e., in a horizontal direction in FIG. 6). Therefore, it is possible to achieve a more stable connection between the coated wire 8 and the coil terminal 28B.

While certain embodiments have been described, these embodiments have been presented by way of example only, and are not intended to limit the scope of the disclosures. Indeed, the novel printing device described herein may be embodied in a variety of other forms; furthermore, various omissions, substitutions and changes in the form of the printing device described herein may be made without departing from the spirit of the disclosures. The accompanying claims and their equivalents are intended to cover such forms or modifications as would fall within the scope and spirit of the disclosures.

What is claimed is:

1. A coil terminal for being electrically connected to a coil that is wound around an electromagnetic block and connected to a coated wire, the coil terminal comprising:

a connection portion capable of being electrically connected to the coil; and a terminal body portion extending from the connection portion and capable of being connected to the coated wire, the coated wire including a coating and a core wire, wherein the terminal body portion comprises a base portion formed on a first end of the coil terminal, and a pair of parallel beam portions extending toward a second end of the coil terminal from the base portion, the parallel beam portions being protruded in a thickness direction of the terminal body portion and forming a slit interposed between the pair of parallel beam portions, wherein the coated wire fits within the slit and the slit supports the coated wire so that a distance from the bottom surface of the coated wire to the top surface of the base portion is equal to the thickness of the coating of the coated wire, and the core wire directly connects to the base portion without any space therebetween.

2. The terminal of claim 1, wherein the distance between the pair of beam portions is approximately equal in size to the outer diameter of the coated wire at least one point, and the pair of beam portions comprises a holding unit configured to hold the coated wire.

3. The terminal of claim 2, wherein each of the pair of beam portions has a protrusion formed thereon, the protrusion formed on one of the beam portions being protruded toward the other of the beam portions, wherein the protrusion comprises a regulating unit configured to regulate movement of the coated wire in a direction of the thickness of the terminal body portion.

* * * * *